US009816398B2

(12) United States Patent
Sajdak et al.

(10) Patent No.: US 9,816,398 B2
(45) Date of Patent: Nov. 14, 2017

(54) TURBINE SHROUD BLOCK REMOVAL APPARATUS

(71) Applicant: General Electric Company, Schenectady, NY (US)

(72) Inventors: Lukasz Sajdak, Raszyn (PL); John William Herbold, Fountain Inn, SC (US); Philippe Monfort-Moros, Belfort (FR); Charles Vaughn Spanos, Mauldin, SC (US); Michal Wojciech Wnuk, Warsaw (PL)

(73) Assignee: General Electric Company, Schenectady, NY (US)

( * ) Notice: Subject to any disclaimer, the term of this patent is extended or adjusted under 35 U.S.C. 154(b) by 3 days.

(21) Appl. No.: 14/376,706

(22) PCT Filed: Dec. 5, 2013

(86) PCT No.: PCT/PL2013/000158
§ 371 (c)(1),
(2) Date: Aug. 5, 2014

(87) PCT Pub. No.: WO2015/084194
PCT Pub. Date: Jun. 11, 2015

(65) Prior Publication Data

US 2016/0160689 A1 Jun. 9, 2016

(51) Int. Cl.
*F01D 25/28* (2006.01)
*F01D 25/24* (2006.01)

(52) U.S. Cl.
CPC ..... *F01D 25/285* (2013.01); *F01D 25/246* (2013.01); *F05D 2220/30* (2013.01); *F05D 2230/70* (2013.01); *F05D 2240/10* (2013.01)

(58) Field of Classification Search
CPC .. F01D 25/285; F01D 25/246; F05D 2240/10; F05D 2240/11; F05D 2230/70; F05D 2220/30
(Continued)

(56) References Cited

U.S. PATENT DOCUMENTS 3,675,788 A * 7/1972 Cathers ..... B65G 7/08 414/784
3,946,886 A * 3/1976 Robinson ..... B64F 1/22 254/93 R
(Continued)

FOREIGN PATENT DOCUMENTS

CN 101684813 A 3/2010
EP 2169184 A2 3/2010
GB 1211313 A 11/1970

OTHER PUBLICATIONS

International Search Report & Written Opinion for International Application No. PCT/PL2013/000158 dated Mar. 6, 2014, 9 pages.
(Continued)

*Primary Examiner* — Larry E Waggle, Jr.
*Assistant Examiner* — Henry Hong
(74) *Attorney, Agent, or Firm* — Ernest G. Cusick; Hoffman Warnick LLC

(57) ABSTRACT

A turbine shroud block removal apparatus. In one embodiment, the apparatus includes a first base plate including a first armature. The first base plate may be releasably coupled to a first shroud block. The apparatus also may also include a second base plate including a second armature. The second base plate may be releasably coupled to a second shroud block positioned adjacent the first shroud block. Additionally, the apparatus may include an actuator coupled to the first armature of the first base plate and the second armature
(Continued)

of the second base plate. The actuator may change a distance between the first shroud block and the second shroud block.

9 Claims, 7 Drawing Sheets

(58) Field of Classification Search
USPC ..... 254/93 R, 95, 98, 104; 29/252; 248/354.1
See application file for complete search history.

(56) References Cited

U.S. PATENT DOCUMENTS

| | | | | | |
|---|---|---|---|---|---|
| 4,078,290 | A * | 3/1978 | Fletcher | B23P 15/006 | 29/244 |
| 4,304,078 | A * | 12/1981 | Meriwether, Jr. | E04F 21/0015 | 248/354.3 |
| 4,453,863 | A * | 6/1984 | Sutton | E02D 17/08 | 254/93 R |
| 4,752,157 | A * | 6/1988 | Ischebeck | E02D 17/083 | 405/282 |
| 5,080,533 | A * | 1/1992 | Cooper | E02D 17/08 | 405/272 |
| 5,232,313 | A * | 8/1993 | Jennings | E02D 17/083 | 405/282 |
| 5,943,830 | A * | 8/1999 | Truitt | E04G 21/26 | 248/351 |
| 6,233,877 | B1 * | 5/2001 | Monroe | A62B 1/04 | 182/230 |
| 6,746,183 | B1 * | 6/2004 | Sullivan | E04G 25/06 | 248/354.7 |
| 7,020,943 | B2 * | 4/2006 | Cronk | B66C 1/107 | 254/124 |
| 7,101,119 | B2 * | 9/2006 | Cerda | E02D 17/08 | 405/272 |
| 8,381,379 | B2 * | 2/2013 | Holmes | B23P 19/04 | 29/254 |
| 2010/0071183 | A1 * | 3/2010 | McCarvill | F01D 9/041 | 29/244 |
| 2012/0119174 | A1 * | 5/2012 | Cardona | B25F 5/005 | 254/93 R |
| 2012/0145976 | A1 * | 6/2012 | Hynous | B66F 3/08 | 254/98 |
| 2012/0204398 | A1 | 8/2012 | Herbold et al. | | |
| 2012/0272496 | A1 * | 11/2012 | Herbold | F01D 25/285 | 29/402.03 |
| 2012/0317772 | A1 * | 12/2012 | Herbold | F01D 25/24 | 29/402.01 |
| 2014/0356152 | A1 * | 12/2014 | Hynous | F01D 25/24 | 415/201 |

OTHER PUBLICATIONS

First Office Action for CN Application No. 2013800814111, dated Nov. 28, 2016, 11 pages.

* cited by examiner

TURBINE SHROUD BLOCK REMOVAL APPARATUS

BACKGROUND OF THE INVENTION

1. Technical Field

The disclosure is related generally to turbine systems. More particularly, the disclosure is related to a turbine shroud block removal apparatus.

2. Related Art

Conventional turbo machines, such as gas turbine systems, are utilized to generate power for electric generators. In general, gas turbine systems generate power by passing a fluid (e.g., hot gas) through a compressor and a turbine component of the gas turbine system. More specifically, inlet air may be drawn into a compressor and may be compressed. Once compressed, the inlet air is mixed with fuel to form a combustion product, which may be ignited by a combustor of the gas turbine system to form the operational fluid (e.g., hot gas) of the gas turbine system. The fluid may then flow through a fluid flow path for rotating a plurality of rotating buckets and shaft of the turbine component for generating the power. The fluid may be directed through the turbine component via the plurality of rotating buckets and a plurality of stationary nozzles positioned between the rotating buckets. As the plurality of rotating buckets rotate the shaft of the gas turbine system, a generator, coupled to the shaft, may generate power from the rotation of the shaft.

Conventional gas turbine systems typically include multiple shroud blocks positioned within the turbine casing. More specifically, multiple shroud blocks may be coupled to the turbine casing and may be positioned adjacent the tips of the rotating buckets and/or between stator nozzles of the gas turbine system. The shroud blocks may surround the various stages of rotating buckets and stator nozzles of the gas turbine system, and may form the outer boundary of the operational fluid flowing through the gas turbine system during operation.

When a maintenance process is performed on gas turbine system or an adjustment is made to various components of the gas turbine system, the turbine shroud blocks may typically be removed. For example, when maintenance is performed or adjustments are made to the rotating buckets, stator nozzles and/or the shroud block themselves, the shroud blocks may typically be removed to allow a turbine operator to access, maintain and/or adjust a specific component. Conventionally, the shroud blocks are removed manually by the turbine operator. More specifically, the turbine operator may remove the shroud blocks individually by applying a high force to each shroud block using a conventional instrument (e.g., sledgehammer, crowbar). The turbine operator may often utilize a block of wood, to dissipate a portion of the force being applied to shroud block during the removal process. However, the conventional process of removing the shroud blocks manually includes a substantially high risk of damaging the shroud blocks or components of the gas turbine system surrounding the shroud blocks (e.g., rotating buckets). For example, when striking the shroud block during the removal process, the instrument (e.g., hammer) may ricochet after the strike and hit a rotating bucket positioned adjacent the shroud block being removed. Furthermore, the block of wood used to dissipate the force being applied directly to the shroud block may not absorb enough force, which may ultimately cause structural damage to the shroud block being struck. In addition to the risk of damaging the shroud blocks and/or components of the gas turbine system, the conventional removal process may be time consuming and requires that the gas turbine system be completely inoperable for an extended period of time.

BRIEF DESCRIPTION OF THE INVENTION

A turbine shroud block removal apparatus is disclosed. In one embodiment, the apparatus includes: a first base plate including a first armature, the first base plate for releasably coupling to a first shroud block; a second base plate including a second armature, the second base plate for releasably coupling to a second shroud block adjacent the first shroud block; and an actuator coupled to the first armature of the first base plate and the second armature of the second base plate, the actuator for changing a distance between the first shroud block and the second shroud block.

A first aspect of the invention includes a turbine shroud block removal apparatus including: a first base plate including a first armature, the first base plate for releasably coupling to a first shroud block; a second base plate including a second armature, the second base plate for releasably coupling to a second shroud block adjacent the first shroud block; and an actuator coupled to the first armature of the first base plate and the second armature of the second base plate, the actuator for changing a distance between the first shroud block and the second shroud block.

A second aspect of the invention includes a turbine shroud block removal apparatus including: a first base plate including a first armature, the first base plate for releasably coupling to a first shroud block; a second base plate including a second armature, the second base plate for releasably coupling to a second shroud block adjacent the first shroud block; and an actuator coupled to the first armature of the first base plate and the second armature of the second base plate for changing a distance between the first shroud block and the second shroud block, wherein the actuator is positioned adjacent a side surface of the first shroud block and adjacent a side surface of the second shroud block.

A third aspect of the invention includes a turbine shroud block removal apparatus including: a first base plate including a first armature, the first base plate for releasably coupling to a first shroud block; a second base plate including a second armature, the second base plate for releasably coupling to a second shroud block adjacent the first shroud block; and an actuator coupled to the first armature of the first base plate and the second armature of the second base plate for changing a distance between the first shroud block and the second shroud block, wherein the actuator is positioned adjacent a top surface of the first shroud block and adjacent a top surface of the second shroud block.

BRIEF DESCRIPTION OF THE DRAWINGS

These and other features of this invention will be more readily understood from the following detailed description of the various aspects of the invention taken in conjunction with the accompanying drawings that depict various embodiments of the invention, in which.

Figure 1:
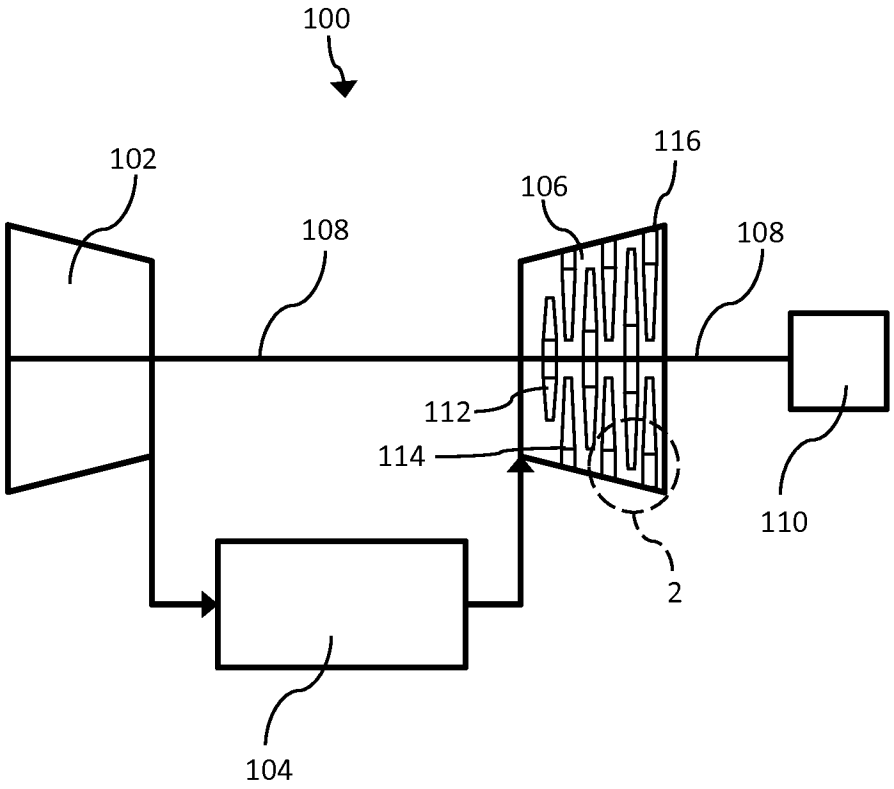
FIG. 1 shows a schematic depiction of a turbine system, according to embodiments of the invention.

It is noted that the drawings of the invention are not necessarily to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

As described herein, aspects of the invention generally relate to turbine systems. More particularly, as described herein, aspects of the invention relate to a turbine shroud block removal apparatus.

Turning to FIG. 1, a schematic depiction of a turbine system is shown according to embodiments of the invention. Turbine system 100, as shown in FIG. 1 may be a conventional gas turbine system. However, it is understood that turbine system 100 may be configured as any conventional turbine system (e.g., steam turbine system) configured to generate power. As such, a brief description of the turbine system 100 is provided for clarity. As shown in FIG. 1, turbine system 100 may include a compressor 102, combustor 104 fluidly coupled to compressor 102 and a turbine component 106 fluidly coupled to combustor 104 for receiving a combustion product from combustor 104. Turbine component 106 may also be coupled to compressor 102 via shaft 108. Shaft 108 may also be coupled to a generator 110 for creating electricity during operation of turbine system 100.

During operation of turbine system 100, as shown in FIG. 1, compressor 102 may take in air and compress the inlet air before moving the compressed inlet air to the combustor 104. Once in the combustor 104, the compressed air may be mixed with a combustion product (e.g., fuel) and ignited. Once ignited, the compressed air-combustion product mixture is converted to a hot pressurized exhaust gas (hot gas) that flows through turbine component 106. The hot gas flows through turbine component 106, and specifically, passes over a plurality of buckets 112 (e.g., stages of buckets) coupled to shaft 108, which rotates buckets 112 and shaft 108 of turbine system 100. Additionally, the hot gas passes over a plurality of stator nozzles 114 (e.g., stages of stator nozzles) coupled to a casing 116 of turbine component 106, where each stage of stator nozzles 114 corresponds to and may be positioned between each of the plurality of buckets 112. The stator nozzles 114 may aid in directing the hot gas through turbine component 106 to continuously pass over, and subsequently rotate each stage of the plurality of buckets 112 of turbine component 106 and shaft 108. As shaft 108 of turbine system 100 rotates, compressor 102 and turbine component 106 are driven and generator 110 may create power (e.g., electric current).

Figure 2:
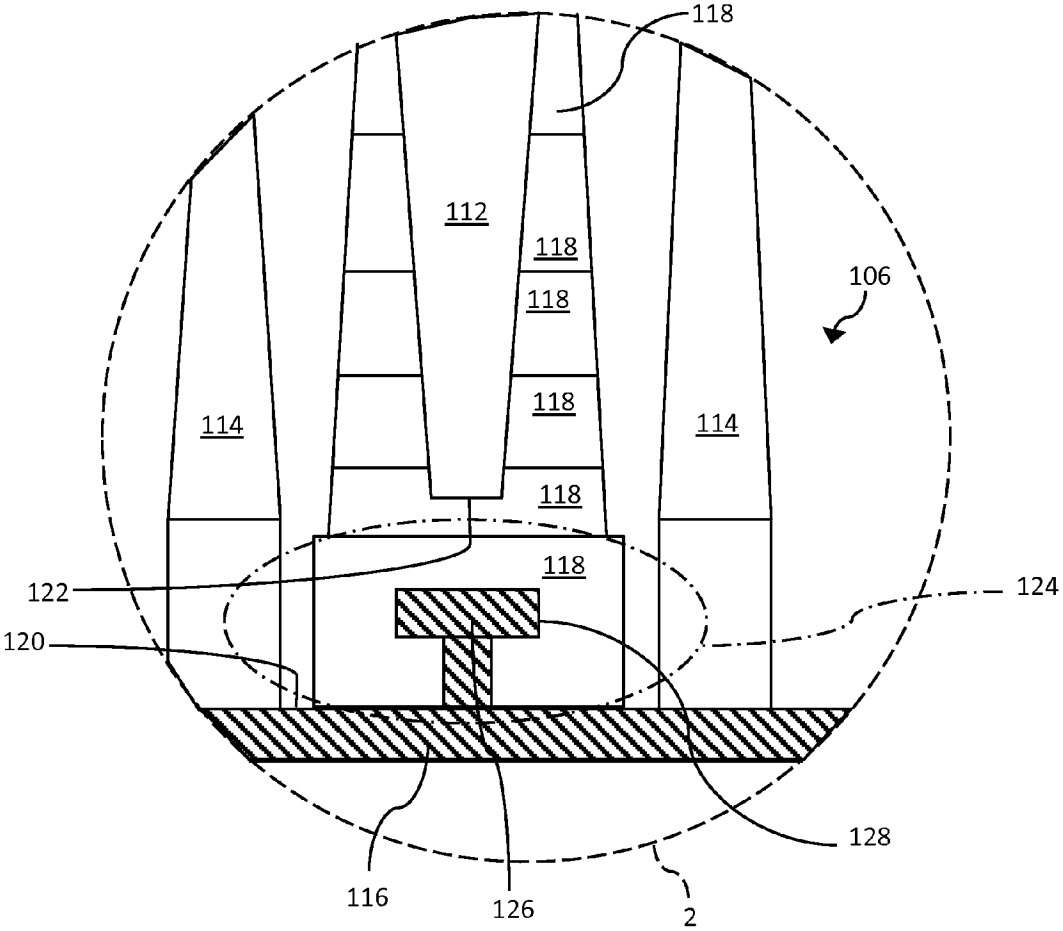
FIG. 2 shows enlarged cross-sectional view of a portion of a gas turbine component in FIG. 1, according to embodiments of the invention.

Turning to FIG. 2, a cross-sectional view of a portion of turbine component 106 of FIG. 1 is shown according to embodiments of the invention. As shown in FIG. 2, turbine component 106 may also include a plurality of shroud blocks 118 coupled to casing 116 and disposed circumferentially around an inner surface 120 of casing 116. That is, as shown in FIG. 2, the plurality of shroud blocks 118 may be coupled to inner surface 120 of casing 116 and may be positioned adjacent a tip 122 of bucket 112. Additionally, the plurality of shroud blocks 118 may be positioned between the various stages of stator nozzles 114 also coupled to casing 116 of turbine component 106. As discussed herein, the plurality of shroud blocks 118 may be circumferentially coupled to and positioned within casing 116 to provide an outer boundary for hot gas as it flows through turbine component 106. That is, the plurality of shroud blocks 118 may be positioned within casing 116 to substantially prevent hot gas from flowing into a region 124, where the hot gas may not flow through turbine component 106 and come in contact with the various stages of buckets 112 and/or stator nozzles 114. When the hot gas of turbine component 106 flows into region 124, the hot gas may not drive the various stages of buckets 112 of turbine component 106, which ultimately decreases the efficiency and/or the power output generated within turbine system 100 (FIG. 1).

As shown in FIG. 2, inner surface 120 of casing 116 may include a connection component 126 configured to couple the plurality of shroud blocks 118 to casing 116 of turbine component 106. More specifically, casing 116 may include a male connection component 126 configured to engage a female opening 128 of the plurality of shroud blocks 118 for coupling the plurality of shroud blocks 118 to casing 116. As shown in FIG. 2, connection component 126 may be positioned substantially in line with buckets 112 and may be positioned between the various stages of stator nozzles 114 of turbine component 106. Connection component 126 may be a continuous component positioned circumferentially around casing 116, such that each of the plurality of shroud blocks 118 may be slidingly engaged or coupled to connection component 126 and subsequently positioned circumferentially around casing 116. Although shown as a male connection component 126, it is understood that connection component 126 and the plurality of shroud blocks 118 may include various alternative configurations for coupling the plurality of shroud blocks 118 to casing 116. For example (not shown), the plurality of shroud blocks 118 may include a male connection portion and connection component 126 of casing 116 may include a female connection configured to substantially receive the male connection portion of shroud blocks 118 for coupling the plurality of shroud blocks 118 to casing 116 of turbine component 106.

Figure 3:
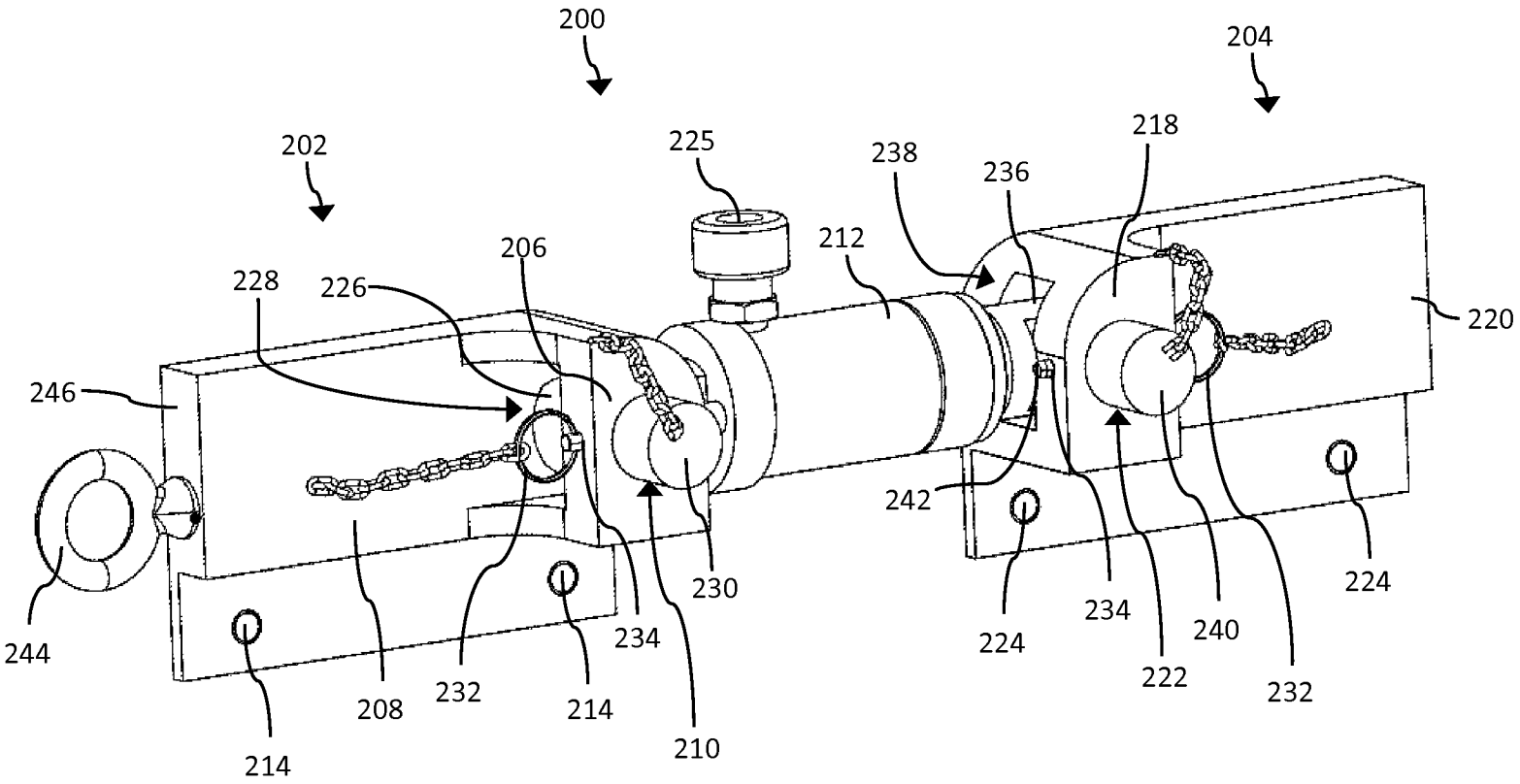
FIG. 3 shows a perspective view of a turbine shroud block removal apparatus, according to embodiments of the invention.

Turning to FIG. 3, a perspective view of a turbine shroud block removal apparatus 200 (hereafter, "removal apparatus 200") is shown according to embodiments of the invention. As discussed herein, removal apparatus 200 may be utilized in a process of removing shroud blocks 118 from casing 116 (FIGS. 4 and 5) when maintenance may be performed and/or adjustments may be made to shroud blocks 118 or other various components of turbine system 100 (e.g., buckets 112, stator nozzles 114). As shown in FIG. 3, removal apparatus 200 may include a first base plate 202 and a second base plate 204 positioned adjacent first base plate 202. As shown in FIG. 3, first base plate 202 may include a first armature 206 extending perpendicularly from body portion 208 of first base plate 202. First armature 206 of first base plate 202 may include a first through-hole 210 formed substantially through first armature 206 and first base plate 202. More specifically, as shown in FIG. 3, first through-hole 210 may be formed completely through first armature 206 and body portion 208 of first base plate 202. As discussed herein, first through-hole 210 may aid in the coupling of an actuator 212 to first base plate 202.

Figure 4:
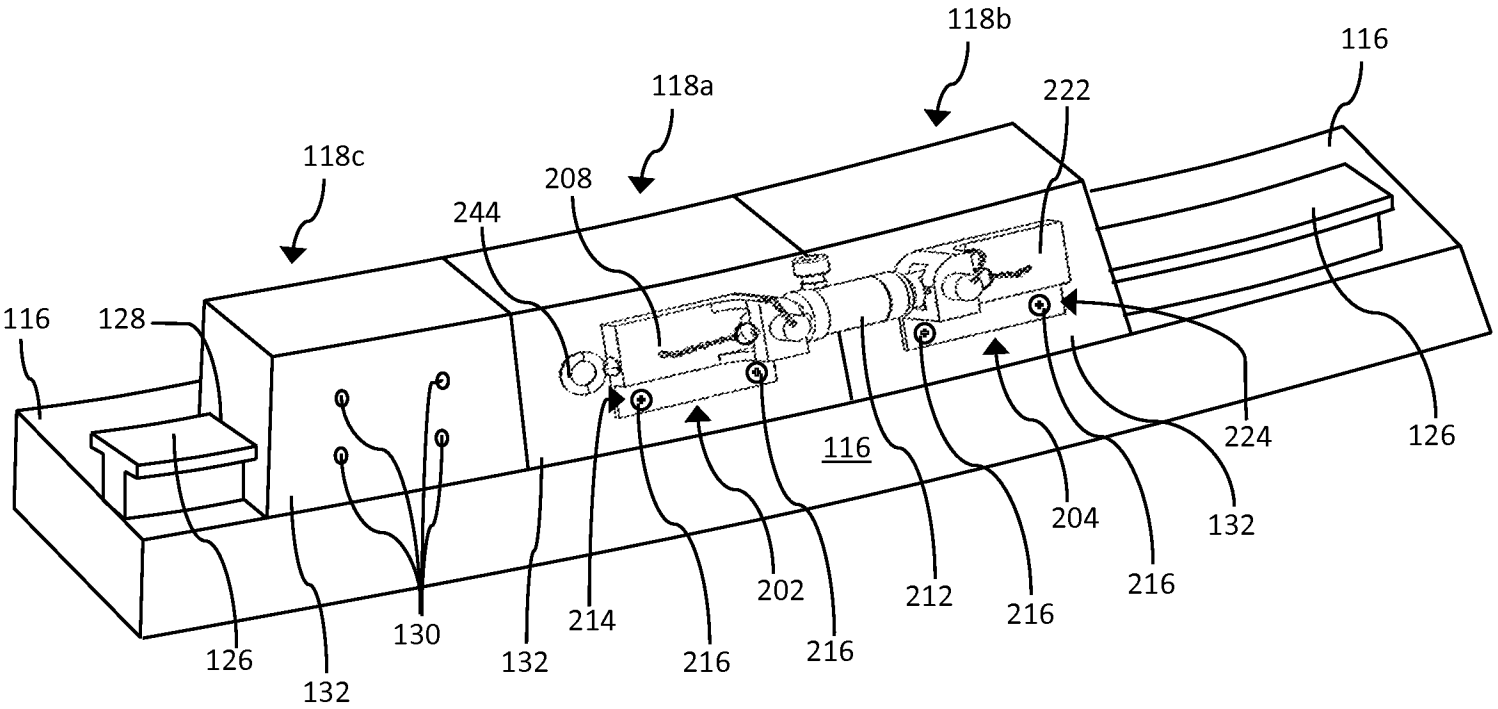
FIGS. 4 and 5 show a perspective view of a portion of a turbine casing including a plurality of turbine shroud blocks and a turbine shroud block removal apparatus of FIG. 3 undergoing a process, according to embodiments of the invention.
Figure 5:
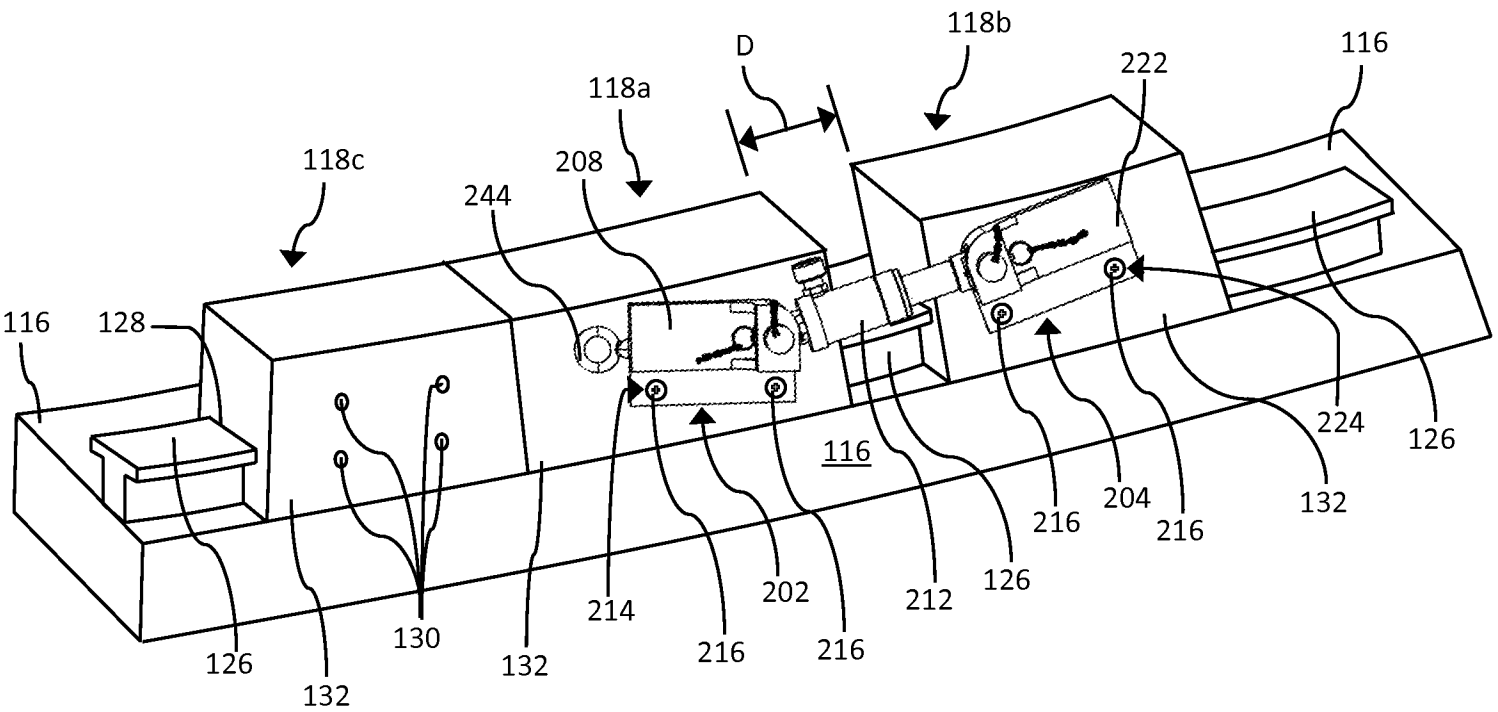

First base plate 202 may also include at least one aperture 214. More specifically, as shown in FIG. 3, first base plate 202 may include at least one aperture 214 formed through body portion 208 of first base plate 202. As discussed herein, the at least one aperture 214 of first base plate 202 may be configured to engage a releasable fastener 216 (FIGS. 4 and 5) for releasably coupling first base plate 202 to shroud block 118 (FIGS. 4 and 5). In an embodiment, as shown in FIG. 3, first base plate 202 may include two distinct apertures 214 formed through body portion 208. However, it is understood that first base plate 202 may include any desired number of apertures 214 to aid in the releasable coupling of first base plate 202 to a shroud block 118 (FIGS. 4 and 5). That is, and as discussed herein, the desired number of apertures 214 of first base plate 202 may be dependent upon a variety of factors, including but not limited to: the number of corresponding holes extending through shroud blocks 118 (FIGS. 4 and 5), the force applied to each of the shroud blocks 118 during the removal process, the force applied by actuator 212 to remove shroud blocks 118, etc.

As discussed above, second base plate 204 may include substantially similar features and/or components as first base plate 202. As a result of the similarities shared between first base plate 202 and second base plate 204, a brief explanation of the features and/or components of second base plate 204 is provided for clarity. As shown in FIG. 3, second base plate 204 may include a second armature 218 extending perpendicularly from a body portion 220 of second base plate 204. Second armature 218 of second base plate 204 may include a second through-hole 222 formed completely though second armature 218 and body portion 220 of second base plate 204 for coupling actuator 212 to second base plate 204, as discussed herein. Additionally, as shown in FIG. 3, second base plate 204 may include at least one aperture 224 formed through body portion 220 of second base plate 204, where the at least one aperture 224 may be configured to engage a releasable fastener 216 (FIGS. 4 and 5) for releasably coupling second base plate 204 to shroud block 118 (FIGS. 4 and 5).

Removal apparatus 200 may also include actuator 212 coupled to first base plate 202 and second base plate 204. More specifically, as shown in FIG. 3, actuator 212 may be coupled to first armature 206 of first base plate 202 and second armature 218 of second base plate 204. As discussed herein, actuator 212 may be configured to change a distance between shroud blocks 118 coupled to first base plate 202 and second base plate 204. As shown in FIG. 3, actuator 212 may include a conventional pneumatic actuator having an air input valve 225 for receiving compressed air to actuate actuator 212. However, it is understood that actuator 212 may include any conventional actuator device or system capable of separating shroud blocks 118 coupled to first base plate 202 and second base plate 204. More specifically, actuator 212 may include, but is not limited to: a pneumatic actuator, an electric actuator, a mechanical actuator, or a hydraulic actuator.

A first end 226 of actuator 212 may be coupled to first armature 206 of first base plate 202. More specifically, first end 226 may include an opening 228 that may be substantially concentric with first through-hole 210 of first armature 206 of first base plate 202. Opening 228 of first end 226 of actuator 212 and first through-hole 210 of first armature 206 of first base plate 202 may engage a first pin 230 for coupling actuator 212 and first armature 206 of first base plate 202. That is, first pin 230 may extend through a portion of first armature 206 such that first pin 230 may be concentrically positioned within opening 228 of actuator 212 and first through-hole 210 of first armature 206 to couple actuator 212 to first armature 206 of first base plate 202. As shown in FIG. 3, first pin 230 may be maintained within first armature 206 of first base plate 202 and opening 228 of actuator 212 by quick release fastener 232. More specifically, quick release fastener 232 may be positioned through fastener aperture 234 of first armature 206 of first base plate 202 and may also be positioned, at least partially through, first pin 230 to substantially prevent first pin 230 from being undesirably removed from first armature 206. By substantially preventing first pin 230 from being undesirably removed from first armature 206, quick release fastener 232 may also prevent first end 226 of actuator 212 from becoming undesirably uncoupled from first armature 206 of first base plate 202.

As similarly discussed above with reference to first end 228 of actuator 212, second end 236 of actuator 212 may be coupled to second base plate 204. More specifically, second end 236 may include an opening 238 that may be concentrically aligned with second through-hole 222 of second armature 218 of second base plate 204. As shown in FIG. 3, and similarly discussed with reference to first pin 230, second end 236 of actuator 212 may be coupled to second base plate 204 via second pin 240. That is, second pin 240 may inserted through second through-hole 222 of second armature 218 and opening 238 of second end 236 of actuator 212 for coupling actuator 212 to second armature 218 of second base plate 204. Additionally, as discussed herein with reference to first base plate 202, second base plate 204 may also include a fastener aperture 234 extending through second armature 218 and quick release fastener 232 for maintaining second pin 240 within second armature 218. That is, quick release fastener 232 may extend through second armature 218 via fastener aperture 234 and, may extend, at least partially, through second pin 240 to substantially prevent second pin 240 from being undesirably removed from second armature 218, and ultimately uncoupling actuator 212 from second base plate 204. As shown in FIG. 3, an end 242 of quick release fastener 232 may extend all the way through a portion of second armature 218 and may be positioned between first base plate 202 and second base plate 204.

Removal apparatus 200 may also include an eyebolt 244 coupled to at least one of first base plate 202 or second base plate 204. As shown in FIG. 3, eyebolt 244 may be coupled to first base plate 202. However, it is understood that eyebolt 244 may be coupled to second base plate 202 (not shown) or both first base plate 202 and second base plate 204. Eyebolt 244 may be coupled to body portion 208 of first base plate 202. More specifically, as shown in FIG. 3, eyebolt 244 may be coupled to an end 246 of body portion 208 of first base plate 202. Eyebolt 244 may be permanently or releasably coupled to end 246 of first base plate 202 using any conventional coupling technique (e.g., welding, brazing, soldering, etc.) and/or coupling component (screw, nut-and-bolt assembly, snapfit, etc.). As discussed herein, eyebolt 244 may be utilized during the removal process of shroud blocks 118.

Turning to FIGS. 4 and 5, a portion of casing 116 including a plurality of turbine shroud blocks 118*a*, 118*b*, 118*c* and removal apparatus 200 undergoing a shroud block 118 removal process is shown, according to embodiments of the invention. As shown in FIGS. 4 and 5, removal apparatus 200 may be releasably coupled to two distinct shroud blocks

118*a*, 118*b* in order to separate the two distinct shroud blocks 118*a*, 118*b*, and subsequently remove one of the shroud blocks (e.g., shroud block 118*b*), as discussed herein. First base plate 202 may be coupled to first shroud block 118*a*, and second base plate 204 may be coupled to second shroud block 118*b* positioned adjacent first shroud block 118*a*. As shown in FIGS. 4 and 5, first shroud block 118*a* may be coupled to casing 116 and second shroud block 118*b* may be coupled to casing 116 adjacent first shroud block 118*b*. First shroud block 118*a* and second shroud block 118*b* may be coupled to connection component 126 of casing 116 in a similar way as discussed herein with respect to FIG. 2. Additionally, as discussed herein, casing 116 may include at least one additional shroud block 118*c* coupled to casing 116, where the at least one additional shroud block 118*c* is positioned circumferentially around casing 116. As shown in FIGS. 4 and 5, additional shroud block 118*c* may be positioned adjacent or substantially touching first shroud block 118*a* on casing 116. Additional shroud block 118*c* may also be positioned opposite second shroud block 118*b*, and may be separated from second shroud block 118*b* by first shroud block 118*a*.

The plurality of shroud blocks 118*a*, 118*b*, 118*c* may include at least one hole 130 extending through a side surface 132 of the plurality of shroud blocks 118*a*, 118*b*, 118*c*. As shown in FIGS. 4 and 5, with reference to additional shroud block 118*c*, the plurality of shroud blocks 118*a*, 118*b*, 118*c* may be substantially identical and may each include four holes 130 extending through each side surface 132 of the plurality of shroud blocks 118*a*, 118*b*, 118*c*. Each individual side surface 132 of each of the plurality of shroud blocks 118*a*, 118*b*, 118*c* are positioned adjacent one another. For example, side surface 132 of first shroud block 118*a* may be positioned adjacent side surface 132 of second shroud block 118*b*.

Releasable fasteners 216 may couple removal apparatus 200 to the plurality of shroud blocks 118*a*, 118*b* coupled to casing 116. As shown in FIGS. 4 and 5, releasable fasteners 216 may releasably couple first base plate 202 to shroud blocks 118*a*. More specifically, releasable fasteners 216 may be positioned through each of the apertures 214 of first base plate 202 and positioned within holes 130 of first shroud block 118*a*, where each aperture 214 of first base plate 202 may be in concentric alignment with a respective hole 130 of first shroud blocks 118*a*. Apertures 214 of first base plate 202 and/or holes 130 of first shroud block 118*a* may engage releasable fastener 216 to releasably couple first base plate 202 to first shroud block 118*a*. Second base plate 204 may be releasably coupled to second shroud block 118*b* in a substantially similar fashion as first base plate 202 and first shroud block 118*a*. That is, as shown in FIGS. 4 and 5, releasable fasteners 216 may be positioned through each of the apertures 224 of second base plate 204 and positioned within holes 130 of second shroud block 118*b*, where each aperture 224 of second base plate 204 may be in concentric alignment with a respective hole 130 of second shroud block 118*b*. Apertures 224 of second base plate 204 and/or holes 130 of second shroud block 118*b* may engage releasable fastener 216 to releasably couple second base plate 204 to first shroud block 118*b*.

As shown in FIGS. 4 and 5, when removal apparatus 200 is coupled to first shroud block 118*a* and second shroud block 118*b*, respectively, actuator 212 of removal apparatus 200 may be positioned adjacent side surface 132 of first shroud block 118*a* and adjacent side surface 132 of second shroud block 118*b*. That is, actuator 212 of removal apparatus 200 may be positioned substantially adjacent to and in parallel to side surface 132 of each of first shroud block 118*a* and second shroud block 118*b*. Actuator 212 may be positioned adjacent to side surface 132 of shroud blocks 118*a*, 118*b* as a result of limited space within casing 116 surrounding shroud blocks 118*a*, 118*b*, 118*c*. For example, in utilizing removal apparatus 200 to remove shroud blocks (e.g., shroud block 118*b*) from casing 116, a user (e.g., turbine operator) may substantially minimize and/or eliminate potential damage to surrounding components (e.g., buckets 112, stator nozzles 114) of turbine component 106 because no blunt force (e.g., hammer strike) is required to remove the shroud blocks 118. As a result, the surrounding components of turbine component 106 (FIG. 1) may still be positioned within casing 116 during the removal of shroud blocks 118. Where there is minimal clearance between tip 122 of bucket 112 (FIG. 2) and turbine shrouds 118*a*, 118*b*, 118*c*, the actuator 212 may be positioned adjacent side surfaces 132 of first shroud block 118*a* and second shroud block 118*b*, respectively. As discussed herein, actuator 212 may be positioned in alternative configurations as well.

Once removal apparatus 200 is releasably coupled to first shroud block 118*a* and second shroud block 118*b*, respectively, removal apparatus 200 may aid in removing second shroud block 118*b*. More specifically, removal apparatus 200 may be utilized to change a distance (D) between first shroud block 118*a* and second shroud block 118*b*, such that second shroud block 118*b* may be disengaged from an operational position within casing 116 and may be subsequently removed from casing 116 by the user (e.g., turbine operator).

As shown in FIG. 5, removal apparatus 200 may be releasably coupled to first shroud block 118*a* and second shroud block 118*b* in a similar manner as discussed above with respect to FIG. 4. Additionally, as shown in FIG. 5, actuator 212 of removal apparatus 200 may be substantially actuated such that a distance (D) separates first shroud block 118*a* and second shroud block 118*b*. In comparison to FIG. 4 where second shroud block 118*b* was positioned adjacent to and/or substantially in contact with first shroud block 118*a*, FIG. 5 shows second shroud block 118*b* separated form first shroud block 118*a* by a distance (D) as a result of the actuation of actuator 212 of removal apparatus 200. As shown in FIG. 5, second shroud block 118*b* may be moved or substantially disengaged from an operational position on casing 116 (e.g., FIG. 4) as a result of the actuation of actuator 212. During the actuation of actuator 212 of removal apparatus 200, first base plate 202 may remain substantially stationary during the changing in the distance (D) between first shroud block 118*a* and second shroud block 118*b*. More specifically, during the actuation of actuator 212, only second base plate 204 and second shroud block 118*b* may move circumferentially around casing 116, and first base plate 202 and first shroud block 118*a* may remain substantially stationary. During the actuation of actuator 212 and the moving of second shroud block 118*b*, removal apparatus 200 may be supported by additional shroud block 118*c* to aid in keeping first base plate 202 substantially stationary. That is, during the changing of the distance (D) between first shroud block 118*a* and second shroud block 118*b*, additional shroud block 118*c* may also remain substantially stationary, and may remain in contact with and/or may be positioned substantially adjacent first shroud block 118*a* to provide directional support for first shroud block 118*a* and/or first base plate 202. As a result of additional shroud block 118*c* remaining substantially stationary and supporting first shroud block 118*a* and first base plate 202 of removal apparatus 200, removal apparatus 200 may apply a desired force to second shroud block 118*b* to change the distance (D), and ultimately allow a user (e.g., turbine operator) to remove second shroud block 118*b* from casing 116. That is, once second shroud block 118*b* is disengaged from an operational positioned within casing 116, a user (e.g., turbine operator) may uncouple second base plate 204 from second shroud block 118*b*, and may slide second shroud block 118*b* circumferentially along casing 116 to remove second shroud block 118*b* from turbine system 100 (FIG. 1). Once second shroud block 118*b* is removed from casing 116, removal apparatus 200 may be releasably coupled to the remaining shroud blocks (e.g., shroud blocks 118*a*, 118*c*) for removing all of the remaining shroud blocks positioned circumferentially around casing 116 in a similar fashion as discussed herein.

Additionally, during the changing of the distance (D) between first shroud block 118*a* and second shroud block 118*b*, eyebolt 244 of first base plate 202 may provide further support to first shroud block 118*a*. That is, eyebolt 244 may be utilized to provide a counter force, in an opposite direction of actuation by actuator 212, in order to substantially ensure that first shroud block 118*a* and first base plate 202 releasably coupled to first shroud block 118*a* remain substantially stationary during the removal or distance (D) changing process performed by removal apparatus 200. For example, a metal-tie (not shown) may be substantially threaded through eyebolt 244 and may be coupled to a portion of casing 116 and/or additional shroud block 118*c* to further prevent movement of first shroud block 118*a*. In a further example, a user (e.g., turbine operator) may apply a counter force to eyebolt 244, in the opposite direction of actuation by the actuator 212, such that first shroud block 118*a* may remain substantially stationary during the removal or distance (D) changing process performed by removal apparatus 200.

Figure 6:
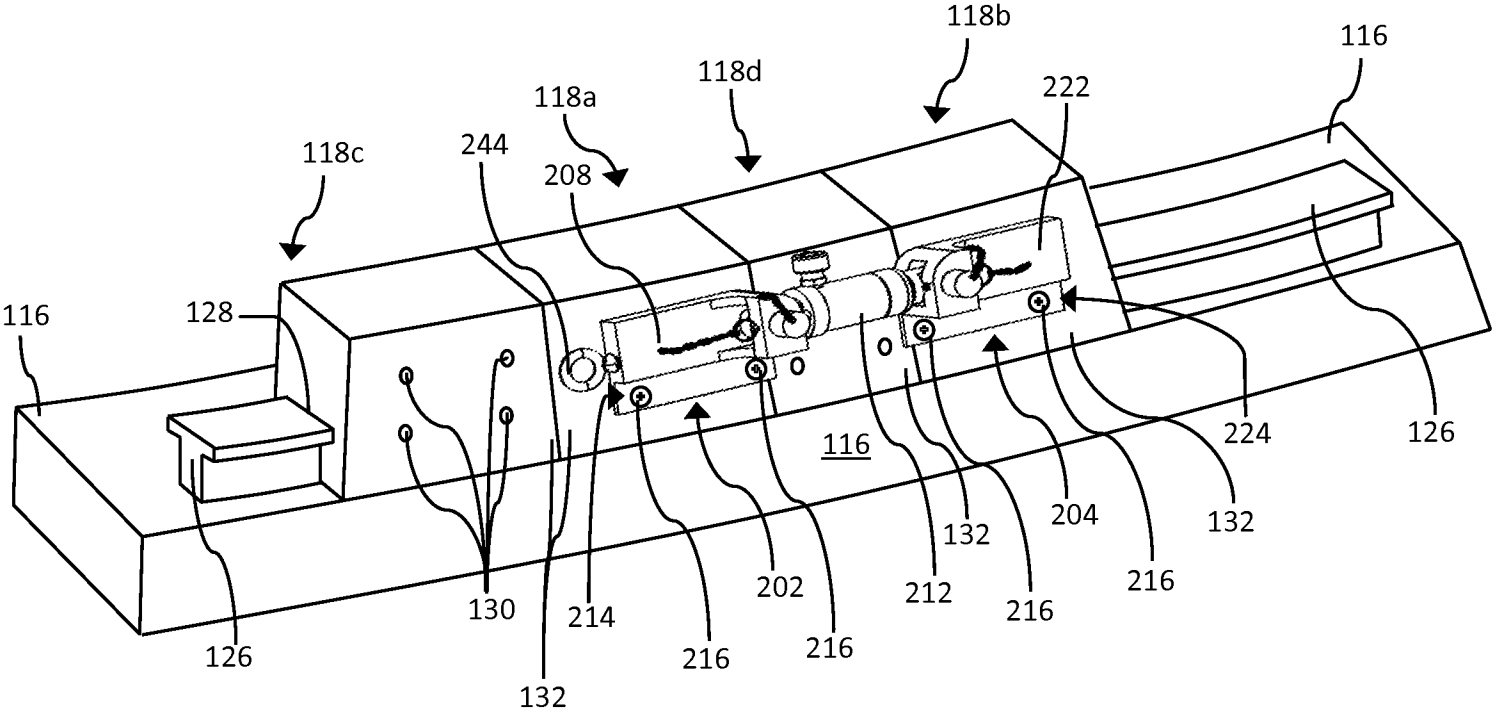
FIG. 6 shows a perspective view of a plurality of turbine shroud blocks and a turbine shroud block removal apparatus, according to an alternative embodiment of the invention.

In an alternative embodiment, as shown in FIG. 6, first shroud block 118*a* and second shroud block 118*b* may be separated by an intermediate shroud block 118*d*. In the Figures, it is understood that similarly numbered components may represent substantially similar components, which can function in a substantially similar manner. Redundant explanation of these components has been omitted for clarity. As shown in FIG. 6, first base plate 202 may be releasably coupled to first shroud block 118*a* and second base plate 202 may be releasably coupled to second shroud block 118*b*, as discussed herein. However, first shroud block 118*a* and second shroud block 118*b* may be separated by intermediate shroud block 118*d*. As similarly discussed above with respect to FIGS. 4 and 5, actuator 212 may change a distance (D), which separates first shroud block 118*a* and second shroud block 118*b* such that second shroud block 118*b* may be disengaged or repositioned from an operational position within casing 116. However, it is understood that intermediate shroud block 118*d* may also remain substantially stationary, along with first shroud block 118*a* and additional shroud block 118*c*, during the actuation of actuator 212 and the changing in the distance (D) between first shroud block 118*a* and second shroud block 118*b*.

Figure 7:
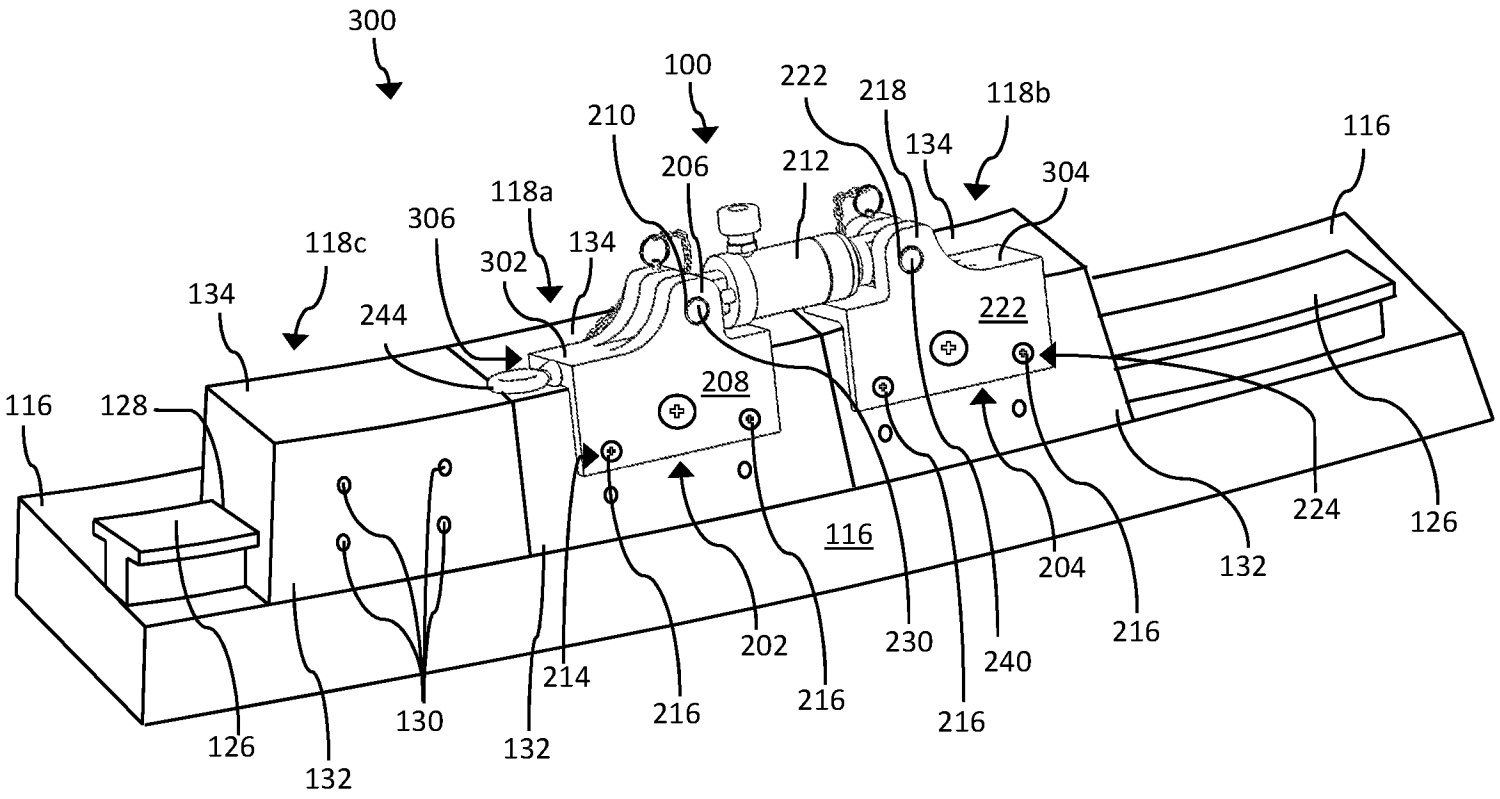
FIG. 7 shows a perspective view of a portion of a turbine casing including a plurality of turbine shroud blocks and a turbine shroud block removal apparatus, according to additional embodiments of the invention.

Turning to FIG. 7, a perspective view of a portion of turbine casing 116 including the plurality of turbine shroud blocks 118*a*, 118*b*, 118*c* and a turbine shroud block removal apparatus 300 (hereafter, "removal apparatus 300") is shown according to an alternative embodiment of the invention. It is understood that similarly numbered components (e.g., first shroud block 118*a*, second shroud block 118*b*, first base plate 202, second base plate 204, actuator 212, etc.) may represent substantially similar components, which can function in a substantially similar manner. Redundant explanation of these components has been omitted for clarity. As shown in FIG. 7, and as discussed herein, removal apparatus 300 may be utilized for removing shroud blocks (e.g., second shroud block 118*b*) from casing 116 of turbine component 106 (FIG. 1).

First base plate 202 of removal apparatus 300 may include an L-portion 302 extending substantially perpendicular to body portion 208 of first base plate 202. That is, as shown in FIG. 7, first base plate 202 of removal apparatus 300 may include L-portion 302 positioned substantially perpendicular to body portion 208 and positioned substantially above first shroud block 118*a*. L-portion 302 may be positioned substantially above first shroud block 118*a* and may substantially engage or rest on a top surface 134 of first shroud block 118*a*. Where first base plate 202 of removal apparatus 300 is releasably coupled to first shroud block 118*a*, body portion 208 may be positioned adjacent to, and may substantially engage side surface 132. Additionally, L-portion 302 may substantially engage and be positioned above top surface 134 of first shroud block 118*a*. As shown in FIG. 7, top surface 134 of first shroud block 118*a* may be positioned perpendicularly above side surface 132, and during operation of turbine system 100 (FIG. 1), may be positioned substantially adjacent tip 122 of buckets 112 (FIG. 2) of turbine component 106 (FIG. 1).

Second base plate 204 may include a substantially similar L-portion 304 compared to L-portion 302 of first base plate 202. That is, second base plate 204 may include L-portion 304 positioned substantially perpendicular to body portion 220 of second base plate 204. As shown in FIG. 7, and similarly discussed with respect to first base plate 202 in FIG. 7, Where second base plate 204 of removal apparatus 300 is releasably coupled to second shroud block 118*b*, body portion 220 may be positioned adjacent to, and may substantially engage, side surface 132 of second shroud block 118*b*. Additionally, L-portion 304 of second base plate 204 may substantially engage and be positioned above top surface 134 of second shroud block 118*b*. As shown in FIG. 7, top surface 134 of second shroud block 118*b* may be positioned perpendicularly above side surface 132, and may be positioned substantially adjacent to, and in circumferential alignment with top surface 134 of first shroud block 118*a*.

In comparison to FIG. 3, first armature 206 of first base plate 202 of removal apparatus 300 may be positioned substantially above body portion 208, and may be positioned substantially perpendicular to L-portion 302. That is, as shown in FIG. 7, first armature 206 may extend substantially perpendicular to L-portion 302, and may extend substantially away from and perpendicular to top surface 134 of first shroud block 118*a*. As shown in FIG. 7, and as similarly discussed with reference to FIG. 3, first armature 206 may include first through-hole 210 positioned substantially through first armature 206. However, first through-hole 210 of first armature 206 of removal apparatus 300 may be positioned substantially above first shroud block 118*a*. As a result, actuator 212 of removal apparatus 300 may be coupled to first armature 206 of removal apparatus 300 above first shroud block 118*a*. More specifically, as shown in FIG. 7, as a result of the positioning of first armature 206 of first base plate 202 of removal apparatus 300, actuator 212 may be coupled to first base plate 202 and may be positioned adjacent top surface 134 of first shroud block 118*a*. As discussed herein, actuator 212 may be coupled to first armature 206 of first base plate 202 by positioning first pin 230 through first through-hole 210 of first armature 206 and opening 228 of first end 226 (FIGS. 4 and 5) of actuator 212, respectively.

As shown in FIG. 7, and as discussed above, second base plate 204 of removal apparatus 300 may include substantially similar features and/or components as first base plate 202 of removal apparatus 300. As a result of the similarities shared between first base plate 202 and second base plate 204 of removal apparatus 300, a brief explanation of the features and/or components of second base plate 204 is provided for clarity. That is, as shown in FIG. 7, second base plate 202 may include an L-portion 304 positioned substantially perpendicular to body portion 220 of second base plate 204. As similarly discussed herein, L-portion 304 of second base plate 204 may be positioned substantially above second shroud block 118*b*, and may rest upon and/or may be connected to top surface 134 of second shroud block 118*b*. Additionally, second base plate 204 of removal apparatus 300 may include second armature 218 extending perpendicularly from L-portion 304 and extending substantially above top surface 134 of second shroud block 118*b*. As similarly discussed with respect to first base plate 202 of removal apparatus 300, actuator 212 may be coupled to second armature 218 of second base plate 204, such that actuator 212 is positioned substantially above second shroud block 118*b*, and substantially adjacent top surface 134 of second shroud block 118*b*. That is, actuator 212 may be coupled to second armature 218 of second base plate 204 by positioning second pin 240 through second through-hole 222 of second armature 218 and opening 238 of second end 236 (FIGS. 4 and 5) of actuator 212, respectively.

As similarly discussed herein, removal apparatus 300 may also include eyebolt 244 coupled to at least one of first base plate 202 or second base plate 204 of removal apparatus 300. As shown in FIG. 7, eyebolt 244 may be coupled to first base plate 202. More specifically, as shown in FIG. 7, eyebolt 244 may be coupled to an end 306 of L-portion 302 of first base plate 202. Eyebolt 244 may be permanently or releasably coupled to end 306 of L-portion 302 of first base plate 202 using any conventional coupling technique (e.g., welding, brazing, soldering, etc.) and/or coupling component (screw, nut-and-bolt assembly, snapfit, etc.). Although shown as being coupled to first base plate 202 of removal apparatus 300, it is understood that eyebolt 244 may be coupled to second base plate 202 (not shown) or both first base plate 202 and second base plate 204 removal apparatus 300.

Removal apparatus 200, 300, as discussed herein, may substantially aid in the removal of shroud blocks 118 within casing 116 of turbine system 100. More specifically, removal apparatus 200, 300 may be utilized by a user (e.g., turbine operator) to remove the each of the plurality of shroud blocks 118 disposed circumferentially around casing 116. In using removal apparatus 200, 300, the user may remove each of the plurality of shroud blocks 118 without requiring crude methods or tools (e.g., sledgehammers, crowbars) to remove the blocks. This may result in a substantial decrease or elimination of damage to the plurality of shroud blocks 118 and/or the various components (e.g., buckets 112, stator nozzles 114) surrounding the plurality of shroud blocks 118 during the removal process. Additionally, because removal apparatus 200, 300 is releasably coupled to each of the plurality of shroud blocks 118, the removal apparatus 200, 300 may be easily installed and uninstalled from the shroud blocks 118. As a result, by utilizing removal apparatus 200, 300, the user may substantially decrease the amount of time it takes to remove each of the plurality of shroud blocks 118 of turbine component 106 (FIG. 1).

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A system comprising:

a turbine casing;

a plurality of shroud blocks coupled to the turbine casing, the plurality of shroud blocks including:

a first shroud block coupled to the turbine casing; and a second shroud block coupled to the turbine casing adjacent the first shroud block; and a shroud block removal apparatus including:

a first base plate including a first armature, the first base plate configured to be releasably coupled to a side surface of the first shroud block of the plurality of shroud blocks;

a second base plate including a second armature, the second base plate configured to be releasably coupled to a side surface of the second shroud block of the plurality of shroud blocks; and an actuator coupled to the first armature of the first base plate and the second armature of the second base plate, the actuator extending at least partially between and parallel to the first base plate and the second base plate, wherein the actuator is configured to change a distance between the first shroud block and the second shroud block of the plurality of shroud blocks.

2. The system of claim 1, wherein the side surface of the first shroud block is positioned adjacent to and in alignment with the side surface of the second shroud block.

3. The system of claim 1, wherein the first shroud block includes at least one hole extending through the side surface of the first shroud block, and wherein the second shroud block includes at least one hole extending through the side surface of the second shroud block.

4. The system of claim 3, wherein the first base plate of the shroud block removal apparatus includes at least one aperture, the at least one aperture of the first base plate and the at least one hole extending through the side surface of the first shroud block configured to receive a releasable fastener to releasably couple the first base plate to the first shroud block.

5. The system of claim 3, wherein the second base plate of the shroud block removal apparatus includes at least one aperture, the at least one aperture of the second base plate and the at least one hole extending through the side surface of the second shroud block configured to receive a releasable fastener to releasably couple the second base plate to the second shroud block.

6. The system of claim 1, wherein the plurality of shroud blocks further includes at least one additional shroud block coupled to the turbine casing.

7. The system of claim 6, wherein the at least one additional shroud block of the plurality of shroud blocks is positioned:

adjacent the first shroud block and opposite the second shroud block, or between the first shroud block and the second shroud block.

8. The system of claim 7, wherein the at least one additional shroud block of the plurality of shroud blocks is substantially stationary during the changing in the distance between the first shroud block and the second shroud block using the shroud block removal apparatus.

9. The system of claim 1, wherein the actuator of the shroud block removal apparatus is positioned one of:

adjacent and parallel to the side surface of the first shroud block and adjacent the side surface of the second shroud block, or adjacent and parallel to a top surface of the first shroud block and adjacent a top surface of the second shroud block.

* * * * *